United States Patent [19]

Windows et al.

[11] Patent Number: 4,630,627

[45] Date of Patent: Dec. 23, 1986

[54] COLLAPSIBLE FRAME STRUCTURE

[76] Inventors: David W. Windows, 1581 40th Ave., NW., Salem, Oreg. 97304; Ronald E. Burback, 1202 SE. Chelsea Ave., Vancouver, Wash. 98664

[21] Appl. No.: 689,292

[22] Filed: Jan. 7, 1985

[51] Int. Cl.[4] ..... E04H 15/48; E04H 15/56

[52] U.S. Cl. ..... 135/112; 135/116; 135/109

[58] Field of Search ..... 135/106, 109, 112, 113, 135/111, 110, 107

[56] References Cited

U.S. PATENT DOCUMENTS

| | | | |
|---|---|---|---|
| 880,183 | 2/1908 | Apple | 135/111 |
| 1,305,306 | 6/1919 | Rasmussen | 135/113 |
| 1,410,830 | 3/1922 | O'Neal | 135/113 |
| 1,590,072 | 6/1926 | Belanger | 135/106 |
| 2,066,342 | 1/1937 | Gorton | 135/113 |
| 2,268,281 | 12/1941 | Tosto | 135/113 |
| 2,434,685 | 1/1948 | Claus | 135/113 |
| 2,828,757 | 4/1958 | Thaxton, Jr. | 135/111 |
| 2,850,027 | 9/1958 | Smith | 135/113 |
| 3,009,471 | 11/1961 | Rossiter | 135/111 X |
| 3,070,106 | 12/1962 | Johnston | 135/112 |
| 3,085,586 | 4/1963 | McDonough | 135/109 |
| 3,266,503 | 8/1966 | Hoiness et al. | 135/112 |
| 3,288,520 | 11/1966 | Krutzikowsky | 135/109 X |
| 3,351,078 | 11/1967 | Kleiman | 135/112 |
| 3,744,195 | 7/1973 | Ferkich | 135/106 |

*Primary Examiner*—Robert A. Hafer
*Assistant Examiner*—D. Neal Muir
*Attorney, Agent, or Firm*—Klarquist, Sparkman, Campbell, Leigh & Whinston

[57] ABSTRACT

A collapsible frame structure has an upper frame section connected to a base frame section by a plurality of hinged struts. Both the upper frame and the base frame section comprise a pair of opposed rigid frame members pivotally connected by opposed hinged frame members. The hinged members fold inward of each section to collapse the section and extend outward to expand the section. The hinged struts fold inward of the structure to raise and lower the upper section relative to the base section. A pair of winches mounted to the base frame section and operatively connected to the struts extend the struts to raise the upper frame section above the base frame section to an operative frame position. Stabilizing members are mounted to an upper portion of the struts to balance the weight of the upper section upon the struts, thus enabling the struts to extend.

4 Claims, 6 Drawing Figures

COLLAPSIBLE FRAME STRUCTURE

BACKGROUND OF THE INVENTION

This invention relates to a collapsible frame structure and more particularly to a portable structure of substantially unitary construction.

Collapsible frame structures of different types are well known. They range from simple tents to temporary buildings. The latter structures are commonly found in circuses, fairs, carnivals, or other places where a large number of temporary shelters are needed. These structures offer a great advantage over more permanent shelters in such circumstances because of their low cost, easy assembly and disassembly, and portability.

One form of a collapsible structure is shown in U.S. Pat. No. 3,744,195 to Ferkich. The frame structure comprises a number of members which are removably interconnected by bolts or the like. Each member is separate from others until joined together by the bolts to form the frame.

A second frame structure of tent form is shown in U.S. Pat. No. 3,085,586 to McDonough. The frame comprises a number of separate tubular beams that are fitted together in brackets and held therein by pins or set screws. Once the frame is constructed, it is erected by a winch to raise the upper frame section above the ground.

U.S. Pat. No. 1,590,072 to Belanger shows a portable tent structure. It includes hinges on its upper and lower frame sections to partially collapse the frame.

The approach illustrated by this prior art suffers from several drawbacks. The individual members of the frame are separate and must be assembled and disassembled in a time-consuming process whenever the frame is erected and collapsed. The overall structure is not easily moved once assembled. Moreover, the disassembled parts must also be carefully tracked to be sure that none is lost in the process of building or taking apart the structure.

Another approach is shown in U.S. Pat. No. 3,351,078 to Kleiman. Kleiman shows a car top camper that is simple to erect or collapse. The frame is of a connected, unitary construction and is erected by means of a series of winches and pulleys. However, Kleiman cannot be used as a temporary shelter. The frame is too small and fragile to support a building of normal size. Moreover, the Kleiman shelter does not readily collapse to a small, portable size but is still of substantial width in its folded position.

Therefore, a need remains for a mobile collapsible frame structure of sufficient strength to form a building of normal size and designed to be quickly erected and collapsed.

SUMMARY OF THE INVENTION

It is an object of the invention to provide an improved collapsible frame structure that can be easily and quickly erected and collapsed with a minimum of labor.

It is a further object of the invention to design a collapsible frame structure that can be easily stored and transported.

Yet another object of the invention is to provide a collapsible frame structure with means to interconnect the members of the frame structure to facilitate their placement and prevent their loss.

Still another object of the invention is to provide a collapsible frame structure of sufficient strength to form a building of normal and useful size.

The foregoing and other objects, features, and advantages of the invention will become more apparent from the following detailed description of a preferred embodiment which proceeds with reference to the accompanying drawings.

DETAILED DESCRIPTION

Figure 1:
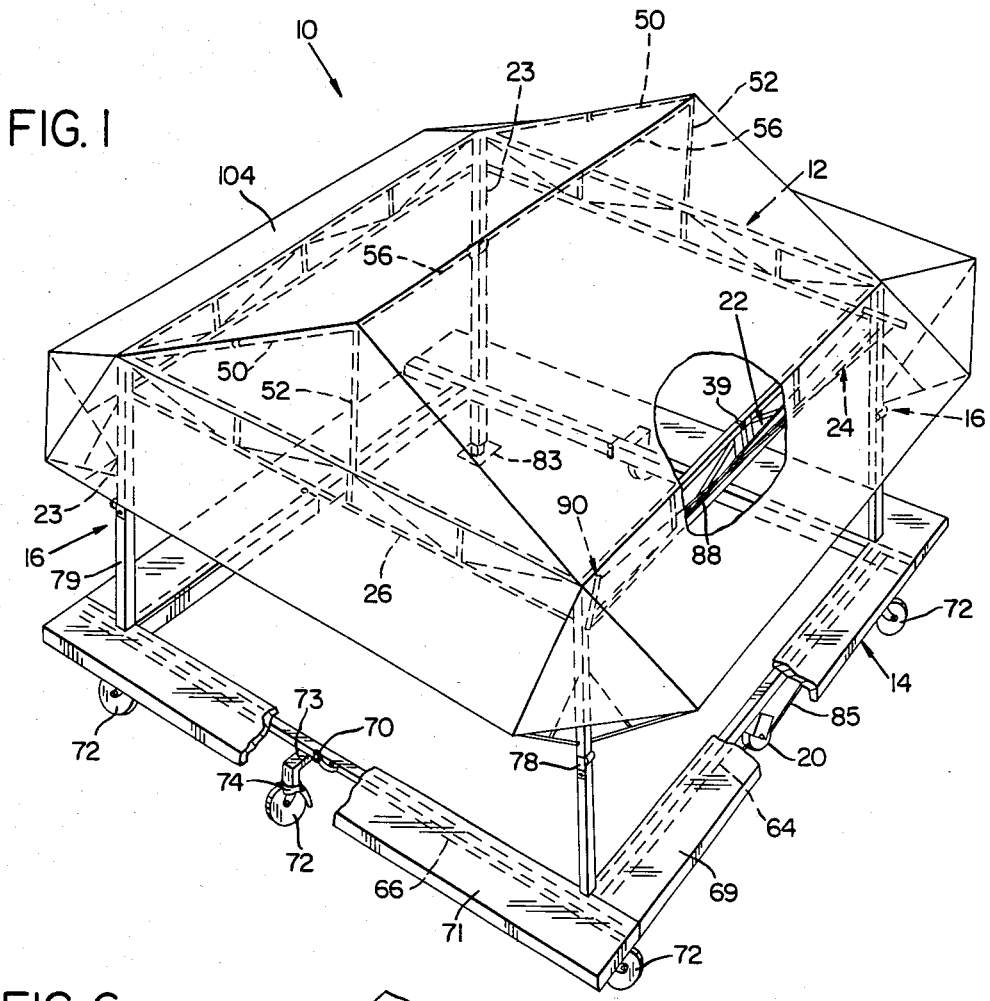
FIG. 1 is a perspective view of the collapsible frame structure of the invention in its operative frame position.
Figure 2:
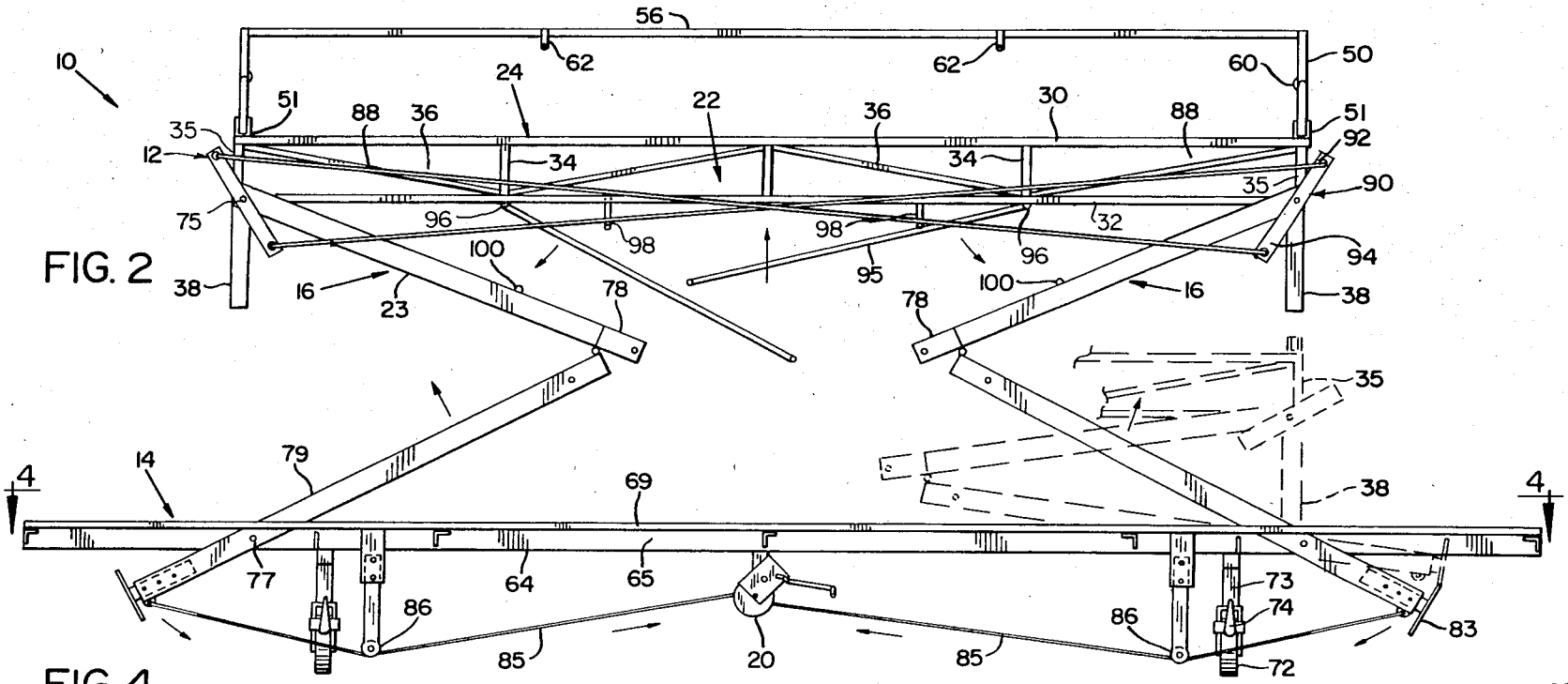
FIG. 2 is a side view of the structure in the partially raised position.

A collapsible frame structure 10 according to the invention is shown in FIGS. 1–6. Referring to FIGS. 1 and 2, the structure comprises an upper frame section 12 and a base frame section 14 connected by collapsible connecting means in the form of struts 16. An elevating means in the form of winches 20 is operatively connected to the connecting means to expand the connecting means. The elevating means thereby raises the upper section 12 relative to the base section 14 to an operative frame position above the base section. The elevating means is operative also to lower the upper section 14 to a stored frame position (shown by dotted lines in FIG. 2) adjacent the base section 14.

To enable the elevating means to successfully expand the connecting means, we provide stabilizing means. These means comprise stabilizing members 22 associated with an upper portion 23 of the connecting means. The stabilizing means balances the weight of the upper section 12 upon the connecting means as the means expands.

Figure 4:
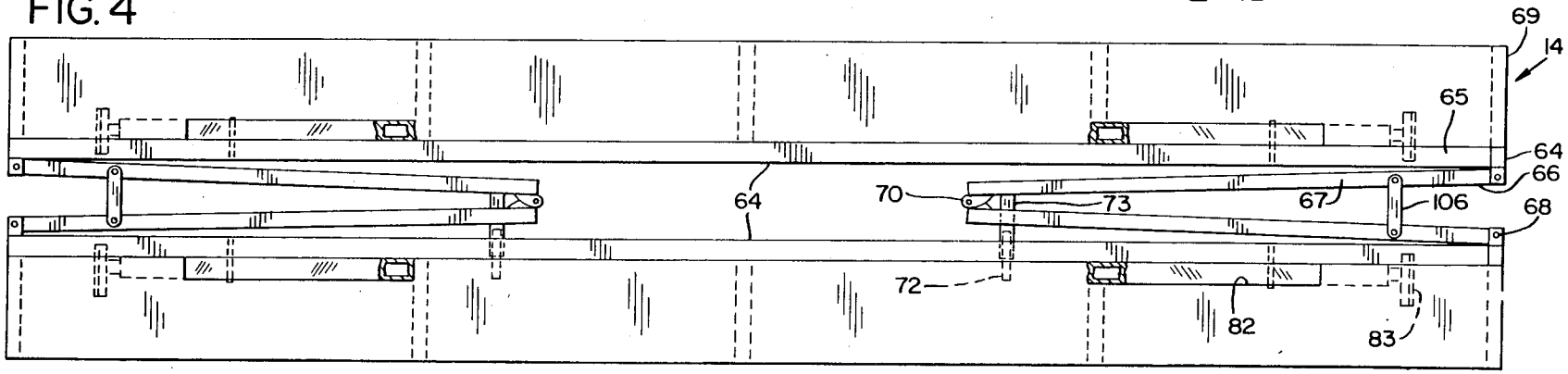
FIG. 4 is a top plan view of the fully collapsed base section of the structure.
Figure 5:
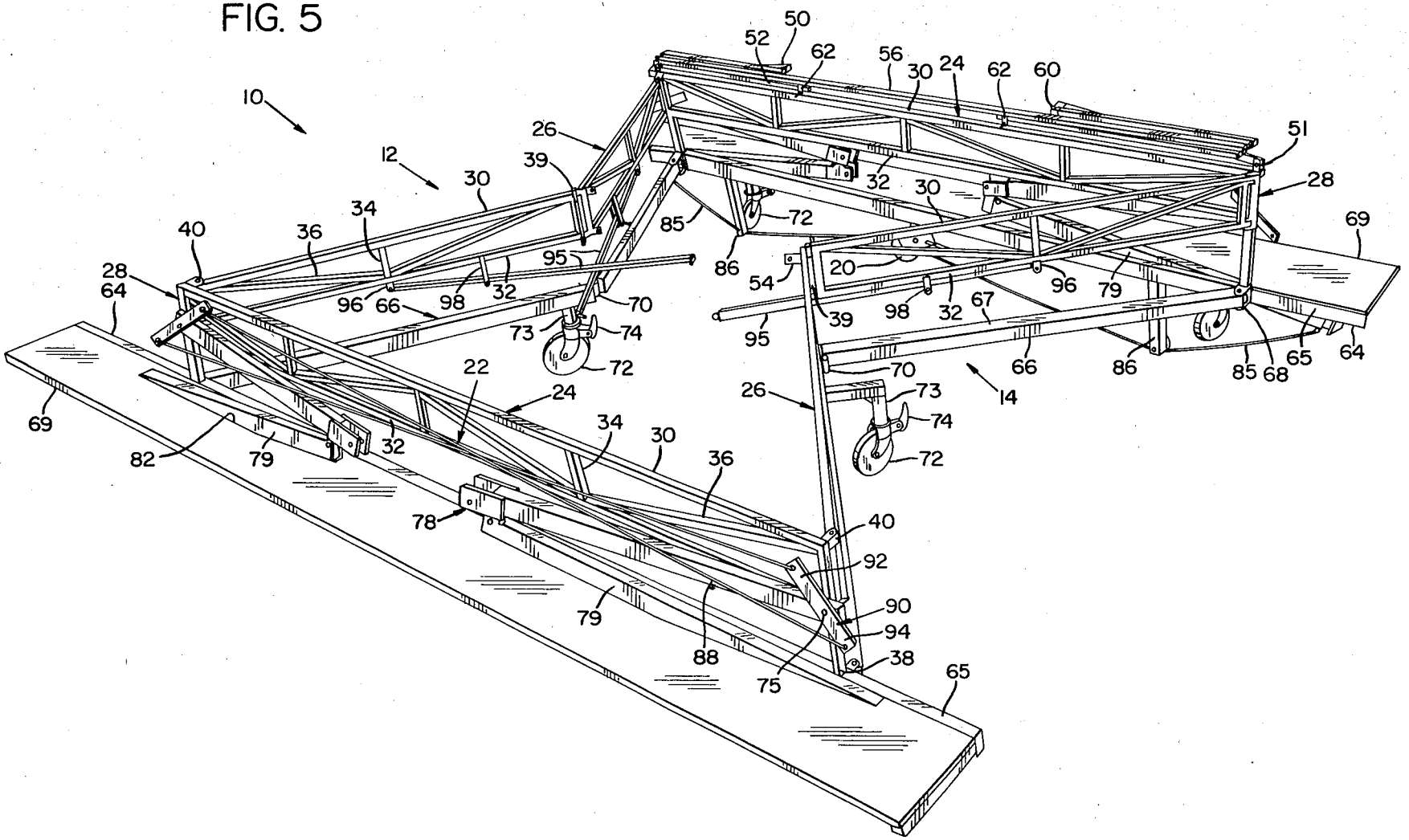
FIG. 5 is a perspective view of the structure partially expanded.

The upper and base frame sections 12, 14 are each collapsible from an expanded horizontal position to a folded horizontal position. FIG. 5 shows the sections 12, 14 partially collapsed. FIG. 4 shows the base section 14 fully collapsed to its folded position. The width of the upper and base sections 12, 14, in their folded positions is less than one-quarter the width of the sections in their expanded positions.

Figure 3:
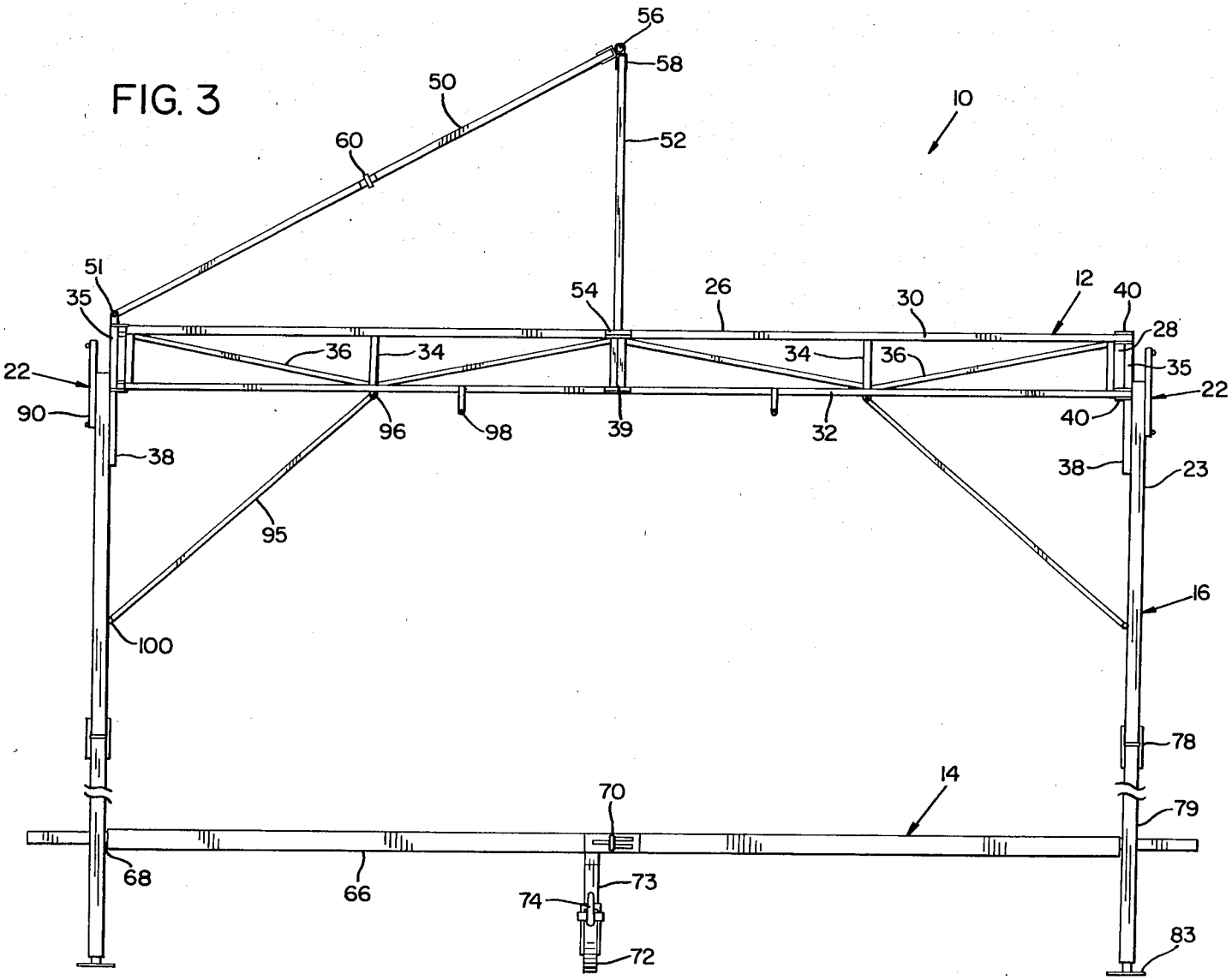
FIG. 3 is a different side view of the fully raised structure.

Considering the upper frame section 12 in FIGS. 2, 3, and 5, it comprises a pair of horizontal opposed rigid frame members 24 pivotally connected to a pair of opposed collapsible horizontal frame members 26 at corner hinges 28. Each member 24, 26 is constructed of a pair of parallel upper and lower longitudinal beams 30, 32 connected by vertical and diagonal support struts 34, 36, respectively. Vertical struts 35 close each end of members 24 and extend below the lower longitudinal beam 32 to form a stop 38 for limiting the downward movement of the upper section 12, as described hereafter. The collapsible members 26 are adapted to expand and collapse upper section 12 by means of a hinge 39 that hinges each member 26 intermediate of its ends.

Each corner hinge 28 is formed by a pair of horizontal clevises 40 welded to the ends 35 of members 24. Clevises 40 bracket the adjacent extended ends of the upper and lower beams 30, 32 of members 26. Each intermediate hinge 39 is of conventional design.

The corner and intermediate hinges 28, 39 allow the hinged members 26 to fold inward of the rigid members 24 to collapse the upper section 12 into its folded horizontal position, as shown in FIG. 5. To expand section 12 to its operable expanded horizontal position of FIG. 1, the hinged members 26 are extended at the hinges 39 until straight. The upper frame section 12 is collapsible in the folded position to a width substantially less than its width in the expanded position (less than one-quarter of such width) for easy storage and transportation of structure 10.

To form a roof or apex on the frame structure, collapsible pitch means are connected to the upper frame section 12 and are adapted to be moved upwardly therefrom. Referring to FIGS. 2 and 3, the pitch means comprise a pair of hinged diagonal braces 50 and a pair of corresponding vertical supports 52 for supporting a ridge pole 56. Each brace 50 is pivotally connected at its lower end to a respective end strut 35 of one rigid frame member 24 by a clevis 51. Each support 52 is connected at its lower end to a bracket 54 adjacent each hinge 39 on respective members 26. Braces 50 and supports 52 intersect at their upper ends in a double clevis joint 58 to support ridge pole 56. Each brace 50 is hinged intermediate of its ends at a hinge 60 to fold it inwardly of the section 12 when retracted.

In the fully erect and operable position shown in FIG. 3, the braces 50 and supports 52 support ridge pole 56 above upper frame section 12 lengthwise of the center. To retract the pole 56 to the stored position of FIG. 5, the supports 52 are removed from brackets 54 and pivoted upward to retaining clevises 62 on pole 56. Braces 50 are folded inward at intermediate hinges 60 and swiveled parallel to the rigid member 24. This combined action brings the ridge pole down to store it over the rigid member 24.

The detailed structure and operation of base frame section 14 is similar to upper section 12. Referring to FIG. 5, section 14 comprises a pair of opposed rigid members 64 pivotally connected to opposed hinged members 66 at corner hinges 68. Members 64 comprise a single rigid bar 65. A wooden frame 69 is fastened to the bar to provide greater width to the member. Each member 66 comprises a single bar 67 hinged intermediate of its ends at a hinge 70. The corner hinges 68 are clevis hinges similar to the corner hinges 28 on the upper section 12. The intermediate hinges 70 are similar to intermediate hinges 39 of members 26, although of larger proportion.

The hinged members 66 fold inwardly at hinges 70, as shown in FIGS. 4 and 5, to collapse the base section into its folded position. The hinged members are extended at the hinge 70 to expand the base section 12 to its expanded position of FIG. 1. Wooden frames 71 removably attached to the base section 14 are fastened to the hinged members 66 once the members are completely extended. The base frame section 14 is collapsible in the folded position to a width substantially less than its width in the expanded position, for example, to a width less than one-quarter the width in the expanded position.

Referring to FIGS. 1, 3, and 5, the base frame section 12 is movably supported by wheels 72 mounted near each of the hinges 68 and 70. The wheels are journaled on support brackets 73 that include locking brakes 74. Wheels 72 form a carriage means for moving the entire structure 10 both in its stored and operative frame positions. Once positioned, the structure is anchored by locking the wheels 72 with the brakes 74. The wheels also facilitate the extending and folding of hinged members 66.

The collapsible struts 16 that form the connecting means are adapted to extend and collapse. Referring to FIG. 2, each strut 16 is hinged intermediate of its ends at a hinge 78 of conventional design and is pivotally connected at upper frame section 12 and base frame section 14. More specifically, the upper portions 23 of struts 16 are pivotally connected at connections 75 near the ends of members 24 of the upper frame section, and the lower portions 79 are pivotally connected at connections 77 near the ends of members 64 of base frame section 12. Each strut 16 extends at its intermediate hinge 78 to raise upper section 12 above base section 14 and to fold at hinge 78 to lower the upper section to the base frame section. A locking pin (not shown) is inserted in hinge 78 to lock the struts in the extended position.

Referring to FIGS. 1 and 2, a lower portion of each strut 16 extends below pivotal connection 77 through a slot 82 in the wooden frame 69. Attached to the end of each strut 16 is an adjustable foot 83 that may be lowered to the ground to help support the weight of the overall structure 10.

To extend the struts from the folded position, the winches 20 are used. A winch 20 is mounted intermediate the ends of each rigid member 64 of base frame section 12. Cables 85 extend from each side of winch 84 and through corresponding guide rollers 86 to the lower portions 79 of each pair of struts 16. Cranking a winch 20 clockwise winds cables 85 onto winch 20 and pulls connected lower portions 79 of struts 16 inward to an erect position. Strut 16 thus extends from its folded position to raise the upper frame section to its operative frame position. Cranking the winch counterclockwise and pressing the hinges 78 inward folds struts 16 to lower the upper section 12.

Figure 6:
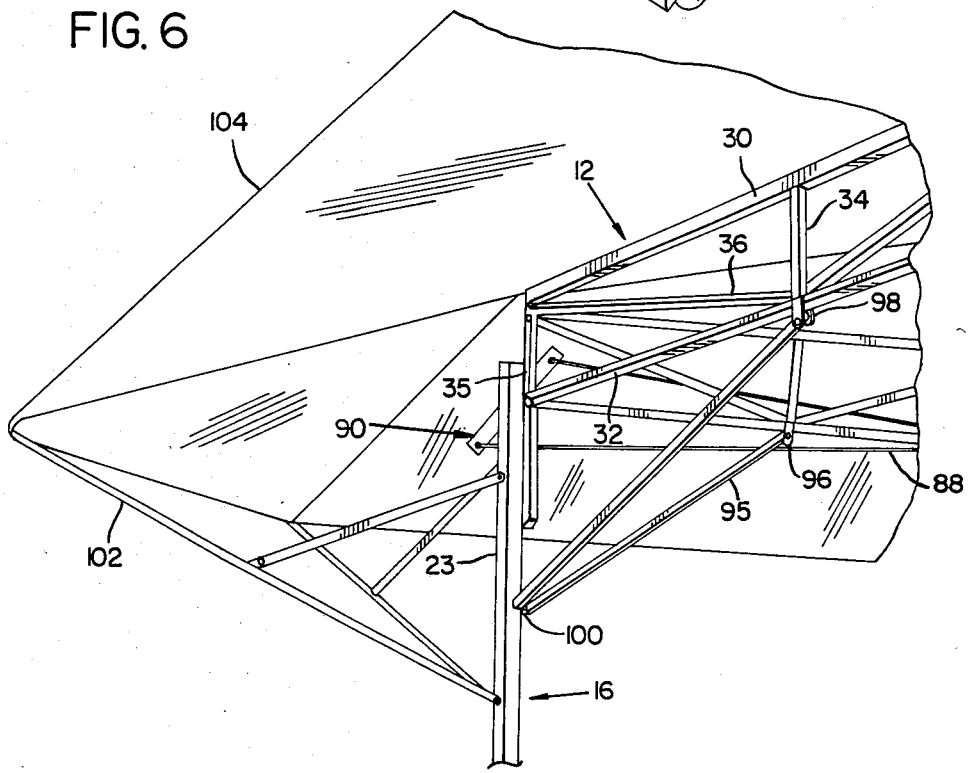
FIG. 6 is a fragmentary perspective view of the structure in its operative frame position.

As shown in FIG. 2, the stabilizing means comprises at least one stabilizing member 22, preferably two, mounted to opposed upper portions 23 of struts 16. The members 22 shown are bars 88, but any tension member, such as a cable, is suitable. In the embodiment shown, the stabilizing means also includes a pair of stabilizing plates 90, each of the plates being welded or otherwise fixedly mounted intermediate first and second portions 92, 94 to the upper portion 23 of a strut 16. So mounted, plates 90 rotate with upper portions 23 such that first portion 92 rotates through the vertical to extend inwardly of upper frame section 12 as the struts are fully extended, as shown in FIGS. 1, 2, and 6. A stabilizing bar 88 is pivotally connected to first portion 92 of one plate and pivotally connected to second portion 94 of the opposite plate. A second bar 88 may be attached in like manner, as shown in FIGS. 1 and 2, the members crossing each other intermediate of plates 90.

Stabilizing bars 88 stabilize the upper frame section 12 as it is raised by equalizing the angular movement of each upper portion 23 relative to each attached lower portion 79. Referring again to FIG. 2, the only connections between struts 16 and frame sections 12, 14 are pivotal connections 75, 77. Without the stabilizing bars 88, the struts could extend unevenly, allowing section 12 to tilt and its weight to shift unevenly over a strut. It has been found that the uneven distribution of weight places so much force on a strut that it cannot be extended by winches 20. The stabilizing bars 88 and plates 90, however, resist any uneven extension of struts 16. The stabilizing bars 88 also stabilize the upper frame section 12 laterally over the base frame section 14 by preventing the struts 16 from tilting off center of the base frame section 14 in parallelogram fashion and collapsing the structure 10. If a leading strut 16 attempts to tilt over a side of the base frame, a bar 88 is placed under tension as second portion 94 on the leading strut 16 attempts to draw apart from diagonally opposed first portion 92 on the following strut 16. Bar 88 prevents such a drawing apart, forcing the struts at their upper pivotal connections 75 to remain centered over their lower pivotal connections 77 to base frame 14, and thereby maintaining upper section 12 centered over section 14. The stabilizing means thus enables the frame to be constructed of a large size sufficient to form a building of normal and useful dimensions. In this embodiment, the upper frame section is raised to a predetermined height of 8 feet above the base frame section and 10 feet above the ground. The apex further increases the height of the structure to about 15 feet.

As shown in FIG. 6, to further stabilize the weight of the upper section 12 on the connecting means 16, a plurality of angled braces 95 brace the upper frame section against upper portions 23 of struts 16. When not in use, the braces 95 each pivot at a hinge 96 on lower beam 32 to store within a retaining clevis 98 on the beam. For use, the braces swing down from the beam and attach to the struts at mounts 100. Awning braces 102 are pivotally connected to the struts 16 near the corner hinges 28 and extend outward from the frame 10 to support a cloth covering means 104.

In operation, the collapsed frame structure is wheeled to the desired location and the wheels locked by the brakes 74. Raising the structure requires only the effort of two persons and can be done in less than 10 minutes. Referring to FIGS. 4 and 5, the upper and base frame sections are initially stored in their folded positions by a locking bar 106 that locks the hinged members 66 together. The upper and base frame sections are expanded by unlocking bar 106 and by pulling the hinged members 26, 66 outward. The hinges 28, 39, 68, and 70 are then locked to prevent collapse of the sections. The cloth covering means 104 is unrolled over the upper section 12. The ridge pole 56 is erected by unfolding the angular braces 50 and erecting the vertical supports 52. The cloth covering 104 is then tied in place.

Persons at each winch 20 crank the winches to unfold the struts 16 and raise the upper frame section 12 to its operative frame position. The hinges 78 are locked securely to prevent the struts 16 from folding inwardly. The feet 83 of the struts may then be lowered for additional support. Braces 95 are securely fastened to struts 16 to further support the upper frame section. Similarly, the awning braces are swung outward to form a framework for the cloth covering 104.

The structure is collapsed by unpinning the hinges 78, pressing struts 16 inwardly and slowly winding the winches 20 counterclockwise to unwind cables 85. This action lowers the upper frame section until it comes to rest with the stops 38 meeting the rigid members 64 of the base frame section. The upper and base frame sections are then collapsed by folding their respective hinged members 26, 66 inwardly. With the structure completely collapsed, the total frame size is substantially less than the size of the expanded frame.

The frame structure overall is of substantially unitary construction with the upper frame section, the base frame section, the connecting means, the elevating means and the stabilizing means connected.

Having illustrated and described the principles of the invention in a preferred embodiment, it should be apparent to those skilled in the art that the invention can be modified in arrangement and detail without departing from such principles.

We claim all modifications coming within the spirit and scope of the following claims:

1. A collapsible frame structure comprising:
an upper frame section;
a base frame section;
at least one pair of opposed hinged struts having upper and lower portions, each of the struts being hinged between its upper and lower portions, the upper portion pivotally connected to the upper frame section and the lower portion pivotally connected to the base frame section, the hinged struts being adapted to extend to raise the upper section to an operative frame position above the base frame section and being collapsible to lower the upper section to a stored position;
a stabilizing plate fixedly mounted adjacent each upper portion of a strut each said plate with an upper and a lower portion;
winch means mounted to the base section and connected to ends of the lower portions of the hinged struts for pivoting the lower portions to extend the struts; and
a pair of stabilizing members linking the upper portions of the struts of the pair to equalize the angular movement of each upper strut portion relative to each hinged lower strut portion, as the struts extend, one of the members being connected to the upper portion of one plate and to the lower portion of the other plate, the other of the members being connected to the upper portion of the other plate and to the lower portion of the one plate, the members crossing each other intermediate the plates.

2. A frame structure as in claim 1 wherein the upper frame section further comprises a collapsible pitch means for supporting a cover on the structure, the pitch means connected to the upper frame section and adapted to move upwardly therefrom to form an apex on the frame structure, the pitch means including a ridge pole extending lengthwise of the structure at the apex.

3. A frame structure as in claim 1 where in each of the pair of stabilizing members comprises a bar.

4. A frame structure as in claim 1 wherein each of the pair of stabilizing members comprises a cable.

* * * * *